US007665211B2

(12) United States Patent
Doss et al.

(10) Patent No.: US 7,665,211 B2
(45) Date of Patent: Feb. 23, 2010

(54) METHOD OF MANUFACTURING A COMBUSTION CHAMBER FOR A WATER HEATER

(75) Inventors: Garrett Doss, Wyoming, MI (US); Michael Gordon, East Grand Rapids, MI (US); Eric M. Lannes, Kentwood, MI (US)

(73) Assignee: Bradford White Corporation, Ambler, PA (US)

( * ) Notice: Subject to any disclaimer, the term of this patent is extended or adjusted under 35 U.S.C. 154(b) by 316 days.

(21) Appl. No.: 11/713,902

(22) Filed: Mar. 5, 2007

(65) Prior Publication Data

US 2007/0163119 A1 Jul. 19, 2007

Related U.S. Application Data

(62) Division of application No. 10/825,992, filed on Apr. 16, 2004, now Pat. No. 7,337,517.

(51) Int. Cl.
*B21D 51/24* (2006.01)
*B21D 53/02* (2006.01)

(52) U.S. Cl. ..... 29/890.03; 29/890.051; 29/525.14; 122/17.1; 122/17.2; 122/18.1; 122/18.3; 122/504

(58) Field of Classification Search ..... 29/890.03, 29/525.14, 890.051; 122/17.1, 17.2, 18.1, 122/18.3, 504
See application file for complete search history.

(56) References Cited

U.S. PATENT DOCUMENTS

| | | | | |
|---|---|---|---|---|
| 2,650,575 | A | 9/1953 | Carlson | |
| 5,511,516 | A | 4/1996 | Moore, Jr. et al. | |
| 5,722,149 | A | 3/1998 | Lesage et al. | |
| 5,941,200 | A | 8/1999 | Boros et al. | |
| 6,116,195 | A | 9/2000 | Valcic et al. | |
| 6,295,952 | B1 | 10/2001 | Reynolds et al. | |
| 6,418,884 | B1 * | 7/2002 | Rucker | 122/504 |
| 6,422,178 | B1 | 7/2002 | Lannes et al. | |
| 6,497,200 | B2 | 12/2002 | Stretch et al. | |
| 6,776,125 | B2 * | 8/2004 | Stretch et al. | 122/14.1 |
| 2001/0035135 | A1 * | 11/2001 | Hughes et al. | 122/155.2 |

* cited by examiner

*Primary Examiner*—David P Bryant
*Assistant Examiner*—Alexander P Taousakis
(74) *Attorney, Agent, or Firm*—RatnerPrestia

(57) ABSTRACT

A method of manufacturing a combustion chamber for use in a water heater is provided. A skirt is formed, and an edge portion of a plate is spot welded to the skirt. The edge portion of the plate is circumferentially welded to the skirt, thereby forming a seal between the plate and the skirt.

10 Claims, 4 Drawing Sheets

METHOD OF MANUFACTURING A COMBUSTION CHAMBER FOR A WATER HEATER

This application is a Divisional of application Ser. No. 10/825,992, filed Apr. 16, 2004 now U.S. Pat. No. 7,337,517, the disclosure of which is expressly incorporated herein by reference.

FIELD OF THE INVENTION

The present invention relates to fuel-fired heating appliances, and more particularly, a method of manufacturing a combustion chamber of a water heater.

BACKGROUND OF THE INVENTION

Fuel-fired water heaters are generally formed to include a water storage tank with a burner disposed in a combustion chamber. For example, gas-fired residential and commercial water heaters are generally formed to include a vertical cylindrical water storage tank with a gas burner disposed in a combustion chamber below the tank. In such water heaters, the burner is supplied with a fuel gas through a gas supply line, and combustion air is supplied through one or more air inlet openings providing communication between ambient air and the interior of the combustion chamber.

In order to permit the flow of combustion air into the combustion chamber, while at the same time prevent the outflow of flames from the combustion chamber, various proposals have been made to provide the combustion chamber with an exterior wall portion having a spaced series of flame quenching openings formed therein. Such openings may be configured to permit the ingress of combustion air into the combustion chamber, while at the same time preventing the passage of combustion chamber flames outwardly through these openings. Accordingly, in the event that extraneous flammable vapors enter the combustion chamber with combustion air inwardly traversing these flame quenching openings, flames resulting from ignition of the incoming flammable vapor will be contained within the combustion chamber.

A fuel-fired heating appliance, such as a water heater, having an improved perforated combustion chamber flame arrestor plate is described in detail in U.S. Pat. No. 6,422,178 B1 to Lannes et al., entitled FUEL-FIRED HEATING APPLIANCE WITH LOUVERED COMBUSTION CHAMBER FLAME ARRESTOR PLATE, which is incorporated herein by reference. Such appliances represent an is improvement over prior designs.

However, there remains a need for an improved method of manufacturing a portion of a combustion chamber that can be used in water heaters generally, including those water heaters having flame arrestor plates.

SUMMARY OF THE INVENTION

In one exemplary embodiment, this invention provides a method of manufacturing a combustion chamber for use in a water heater. A skirt is formed, and an edge portion of a plate is spot welded to the skirt. The edge portion of the plate is circumferentially welded to the skirt, thereby forming a seal between the plate and the skirt.

In another exemplary embodiment, a further method of manufacturing a combustion chamber for use in a water heater is provided. A skirt is formed. A portion of the skirt is circumferentially expanded, and a plate is welded to the expanded portion of the skirt.

In yet another exemplary embodiment, a further method of manufacturing a combustion chamber for use in a water heater is provided. A plate having openings is welded to a skirt. A burner support is welded to the plate at a location substantially devoid of the openings.

DETAILED DESCRIPTION OF THE INVENTION

Figure 1:
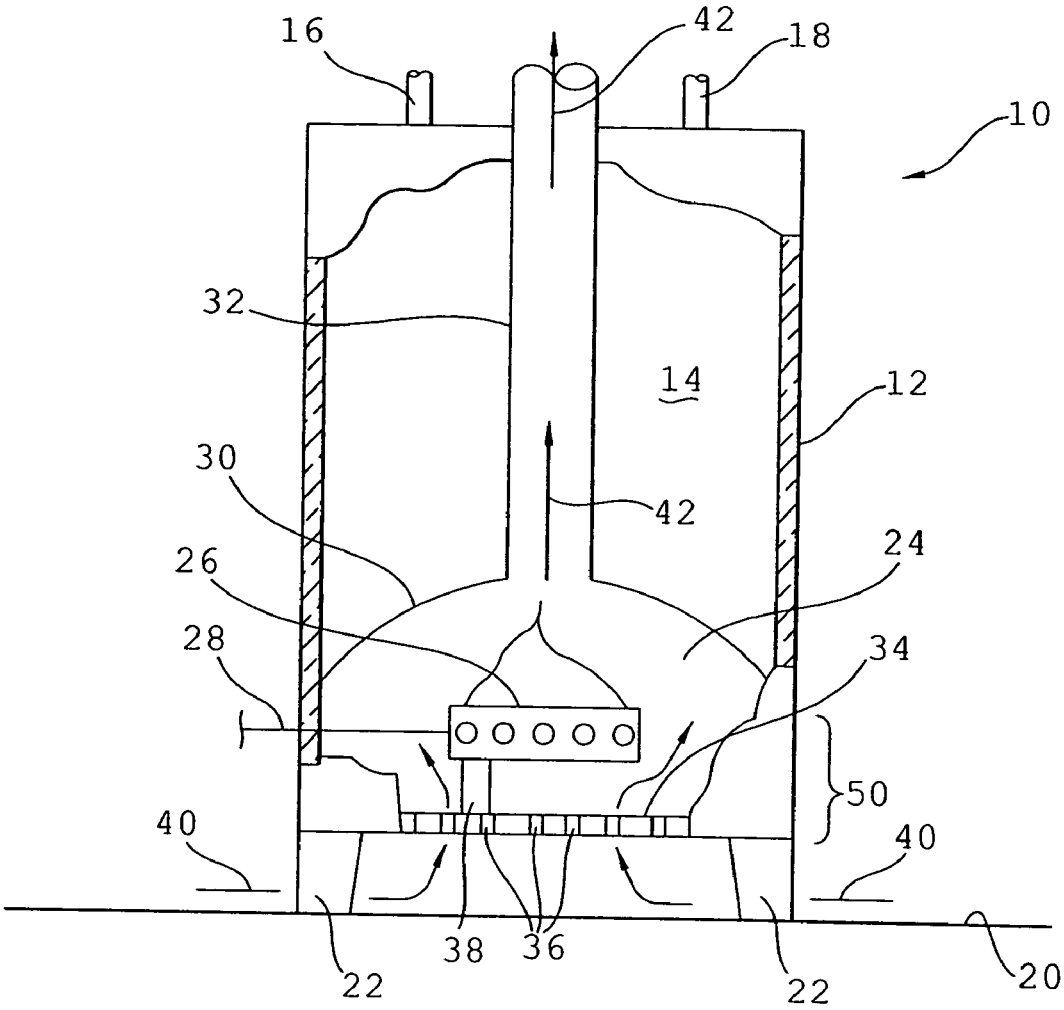
FIG. 1 is a simplified, schematic, partial cross-sectional view of a water heater having incorporated therein an exemplary embodiment of a combustion chamber according to aspects of this invention.

Although the invention is illustrated and described herein with reference to specific embodiments, the invention is not intended to be limited to the details shown. Rather, various modifications may be made in the details within the scope and range of equivalents of the claims and without departing from the invention.

Referring to the figures generally, a method of manufacturing a portion 50 of a combustion chamber 24 for use in a water heater 10 is provided. A skirt 46 is formed, and an edge portion 42E of a plate 42 is spot welded to the skirt 46. The edge portion 42E of the plate 42 is circumferentially welded to the skirt 46, thereby forming a seal between the plate 42 and the skirt 46.

In another exemplary embodiment, a further method of manufacturing at least a portion 50 of a combustion chamber 24 for use in a water heater 10 is provided. A skirt 46 is formed. A portion 52B of the skirt 46 is circumferentially expanded, and a plate 42 is welded to the expanded portion 52B of the skirt 46.

In yet another exemplary embodiment, a further method of manufacturing a portion 50 of a combustion chamber 24 for use in a water heater 10 is provided. A plate 34 having openings 36 is welded to a skirt 46. A burner support 38 is welded to the plate 34 at a location 42S substantially devoid of the openings 36.

Referring now to FIG. 1, a water heater assembly embodying exemplary aspects of this invention is generally designated by the numeral "10." FIG. 1 depicts a commercial or residential water heater. However, the descriptions herein apply to commercial water heaters and residential or domestic water heaters, as well as other heat transfer systems.

The configuration and operation of the water heater 10 are described in detail in U.S. Pat. No. 6,422,178 B1 to Lannes et al., entitled FUEL-FIRED HEATING APPLIANCE WITH LOUVERED COMBUSTION CHAMBER FLAME ARRESTOR PLATE, which is incorporated herein in its entirety. A brief description is included herein for contextual purposes.

Water heater 10 has a vertically oriented, cylindrical insulated metal storage tank 12 which is adapted to hold a quantity of water 14 to be heated and stored for on-demand delivery to a variety of hot water-utilizing plumbing fixtures (not shown)

via a supply pipe 16 connected to the top end of the tank 12. Water 14 drawn from the tank 12 is automatically replenished via a cold water inlet pipe 18 also connected to the top end of the tank 12.

The tank 12 is representatively supported on a floor 20, in an elevated relationship therewith, by depending support legs 22. At the lower end of the tank 12 is a combustion chamber 24 in which a schematically depicted gas burner structure 26 is operatively supported, the burner structure 26 being supplied with fuel gas via a supply line 28 and thermostatically controlled in a conventional manner as a function of the setpoint temperature of the stored water 14. Combustion chamber 24 has a domed top wall 30. It is the method of manufacturing a portion 50 (best viewed in FIG. 2) of the combustion chamber 24 that is the subject of the present invention. A flue 32 extends upwardly from a central portion of the wall 30, through the water 14 and outwardly through the top end of the tank 12, and communicates with the interior of the combustion chamber 24.

A bottom outer wall portion of the combustion chamber 24 is defined by a flame arrestor plate 34 which embodies principles of the present invention and has a spaced series of flame quenching combustion air inlet openings 36 formed therein. The burner structure 26 is held in an elevated relationship with the top side of the flame arrestor plate 34 by a schematically depicted, support structure 38.

During firing of the water heater 10, ambient combustion air 40 is flowed into the combustion chamber 24 via the air inlet openings 36, mixed with fuel gas delivered to the burner structure 26, and combusted to form hot combustion products 42 that upwardly traverse the flue 32 and transfer combustion heat to the water 14 through the sidewall of the flue 32.

The arrestor plate inlet openings 36 function to permit combustion air 40 to be drawn upwardly therethrough into the combustion chamber 24, but preclude downward passage through the openings 36 of flames from the interior of the combustion chamber 24. Accordingly, in the event that extraneous flammable vapors are entrained in the combustion air 40, drawn into the combustion chamber 24 and ignited therein, the resulting flammable vapor flames are kept in the combustion chamber and tend to be self-extinguishing.

Figure 3:
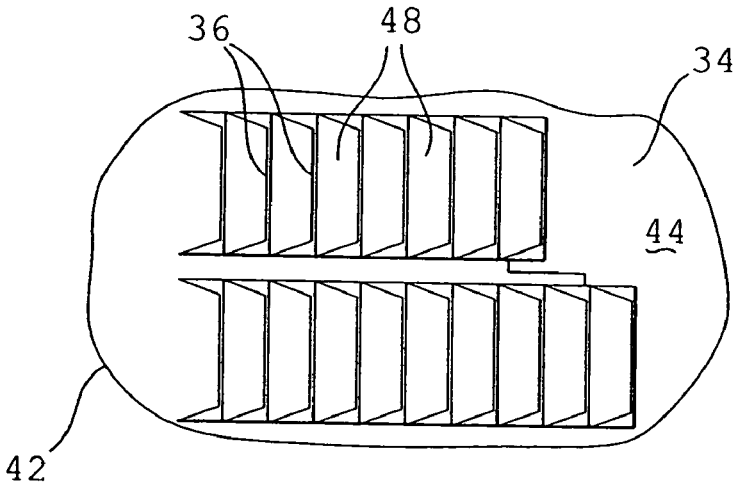
FIG. 3 is a detail view of exemplary flame quenching openings formed in a plate component of the combustion chamber portion illustrated in FIG. 2.
Figure 2:
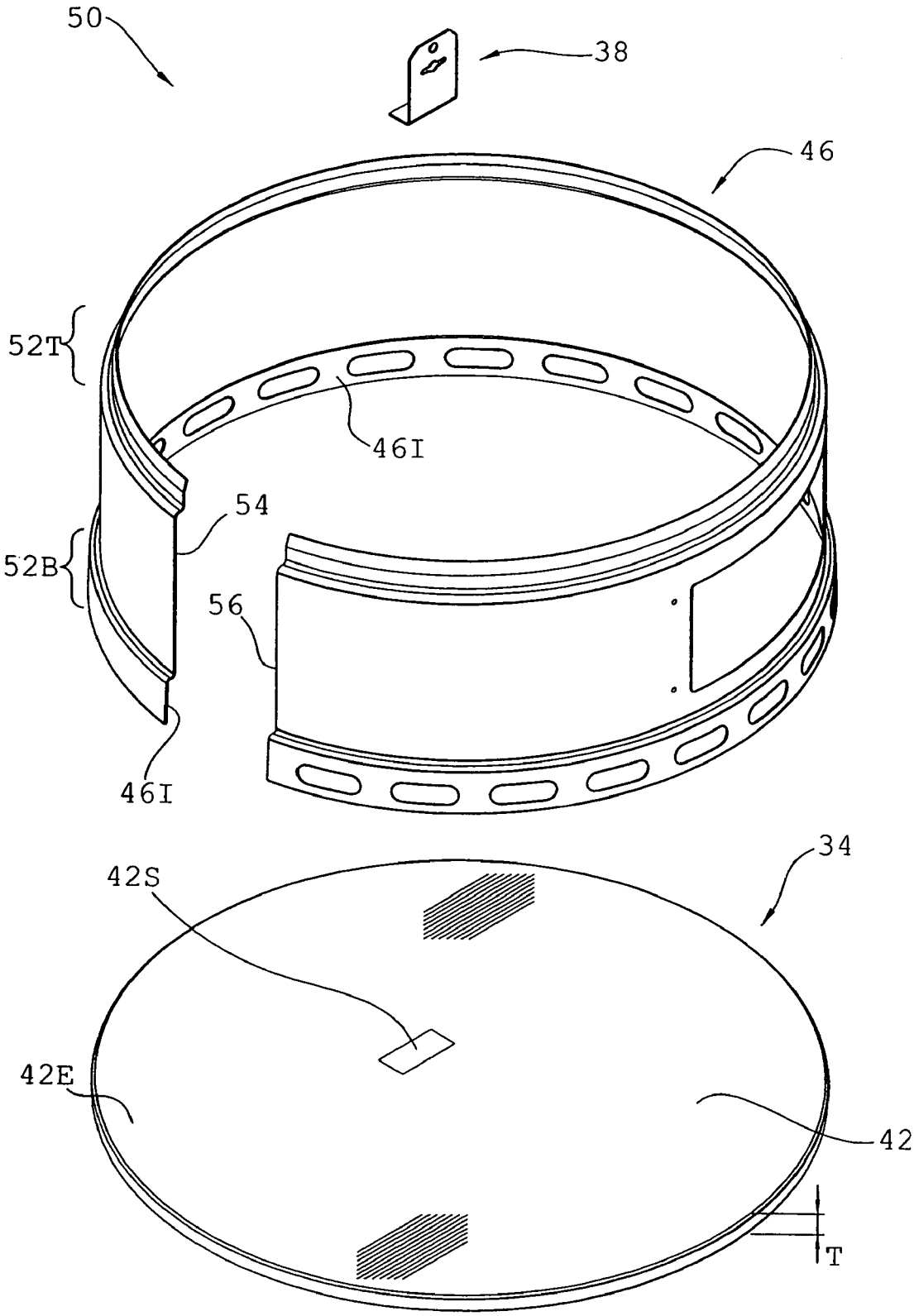
FIG. 2 is an exploded perspective view of a portion of the combustion chamber represented in FIG. 1.

Turning now to FIGS. 2 and 3, the flame quenching perforated arrestor plate 34 is representatively formed from an initially imperforate, substantially planar metal plate body 42 (represented in FIGS. 2 and 3) having an upper side 44 and a lower side (not shown) and a thickness T, which is representatively in the range of from about 0.015" to about 0.040" according to one exemplary embodiment, and is preferably about 0.026" according to another exemplary embodiment, though other dimensions larger and smaller dimensions are optionally selected.

The flame quenching openings 36 (illustrated in FIG. 3) are created using a suitable lancing process to form in the plate body 42 parallel rows of upwardly deformed elongated louvers 48, with each of the flame quenching combustion air inlet openings 36 being disposed between a laterally adjacent pair of the louvers 48. Alternatively, the rows of louvers 48 could be staggered, or in other relative orientations, instead of being parallel. While the use of louvers 48 can be selected according to one embodiment of the invention, the openings 36 are optionally formed in other manners. Also, the shape, quantity, size, and positioning of the openings 36 can be modified from the embodiment selected for illustration in the figures.

As can best be seen in FIG. 2, an exemplary embodiment of the portion 50 of the combustion chamber 24 includes a skirt 46, a flame arrestor plate 34, and a burner support bracket 38. Generally, portion 50 provides a side wall, air inlet openings, and a burner mounting structure for a combustion chamber such as chamber 24. While the skirt 46, flame arrestor plate 34, and burner support bracket 38 form a subassembly used to form combustion chamber 24, additional structural elements of the water heater 10 define the remainder of combustion chamber 24.

For example, a domed top wall 30, which can also provide a bottom wall of the storage tank 12, can form a top wall of the combustion chamber 24. Other elements can also be provided to complete the combustion chamber 24.

The skirt includes a top circumferential portion 52T and a bottom circumferential portion 52B. The plate body 42 has a circular shape and is diametrically configured to cover essentially the entire bottom side of the combustion chamber 24. Representatively, a substantially larger sheet of metal has louvers 48 (illustrated in FIG. 3) lanced therein and has the circular body 42 suitably removed therefrom. The removed circular body 42 has the louvers crimped down around its periphery to form an annular, imperforate peripheral area or edge portion 42E which facilitates the connection of the body 42 at the bottom portion of the combustion chamber 24. While the edge portion 42E illustrated in FIG. 2 optionally extends inwardly from the outer edge of circular body 42, the portion of body 42 with crimped louvers is optionally limited to the periphery or side surface of the body 42.

Alternatively, circular body 42 can be formed from a circular imperforate plate in which openings such as those defined by louvers 48 are formed. In this scenario, such openings can be formed in the circular body 42 in all locations except at edge portion 42E.

Additionally, louvers 48 found in a rectangular area 42S are crimped down to form on the top side of the body 42 an imperforate securement area 42S on which the burner support structure 38 may be suitably mounted. Alternatively, the openings defined by louvers 48 can be formed in the circular body in all locations except at edge portion 42E.

While it is contemplated that the imperforate areas 42E and 42S could initially be formed without perforations, the exemplary embodiment of body 42 is formed from a substantially larger sheet of metal having louvers 48 and has the circular body 42 suitably removed therefrom. The removed circular body 42 has the louvers crimped down around its edge portion 42E, which facilitates the assembly of the arrestor plate 34 to the remainder of the combustion chamber 24, and at securement area 42S, which facilitates the assembly of the burner support 38 to the arrestor plate 34.

Portion 50 of the combustion chamber 24 is not illustrated in its assembled configuration. As will be described subsequently herein, the assembled portion 50 includes a continuous skirt (not shown in its continuous form) with the arrestor plate 34 welded to the inner surface 46I of the skirt 46 and the burner support bracket 38 welded to the securement area 42S of the arrestor plate 34.

In the exemplary embodiment illustrated in the figures, the only path for air into the combustion chamber 24 is via the inlet openings 36 defined by louvers 48 (illustrated in FIG. 3). In order to substantially or completely prevent the flow of air into the combustion chamber 24 at the juncture of the flame arrestor plate 34 and the skirt 46 (i.e., where the outer circumferential edge 42E of the flame arrestor plate 34 meets the inner surface 46I of the skirt 46), thereby bypassing the inlet openings 36 defined by louvers 48, a seal is provided at the juncture of the flame arrestor plate 34 and the skirt 46. An exemplary method of manufacturing the portion 50 in such a way as to form the seal will be described in the following paragraphs.

Figure 4A:
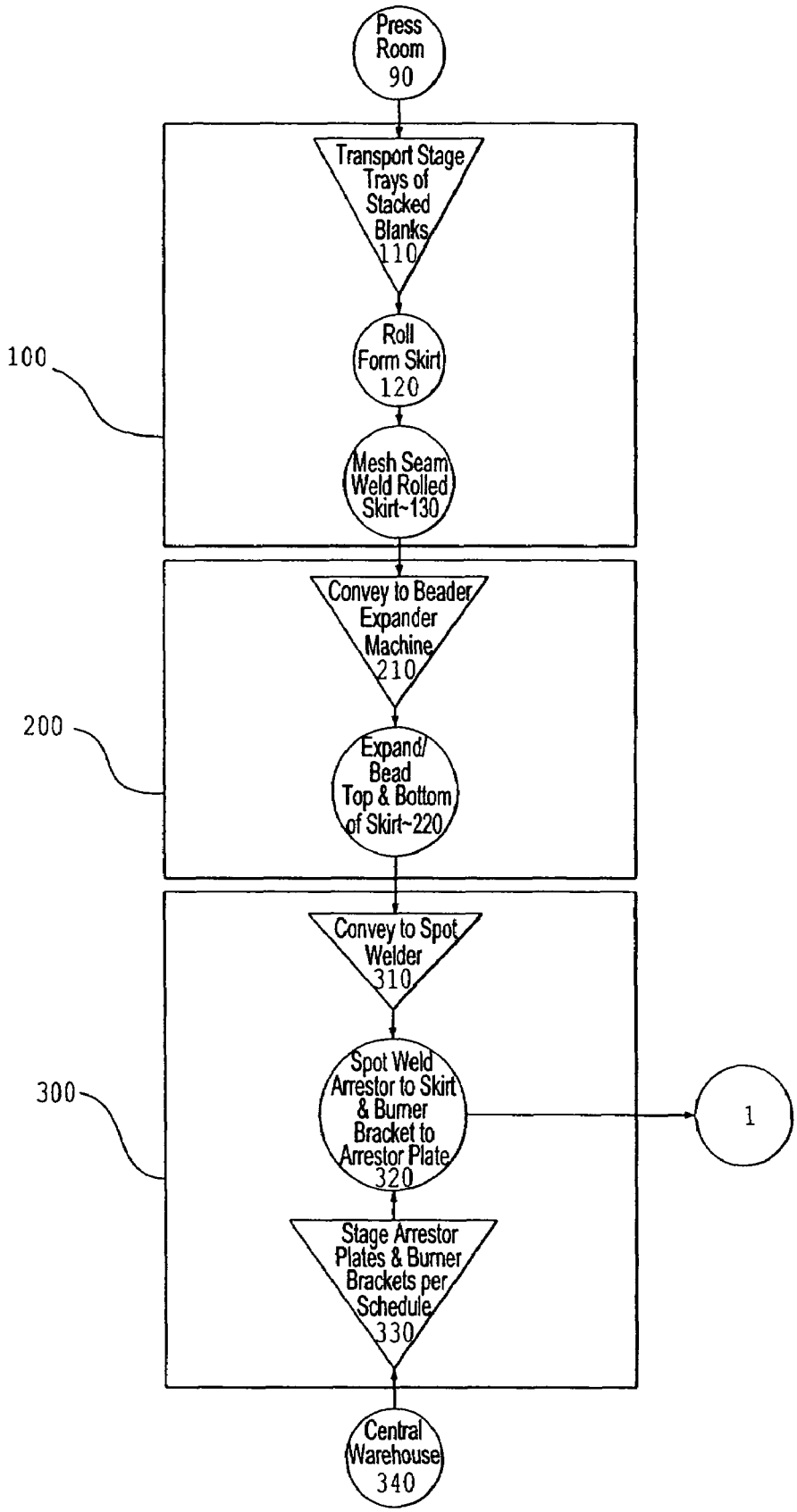
FIG. 4A is a flow chart representing an exemplary method of manufacturing a portion of a combustion chamber according to aspects of this invention.
Figure 4B:
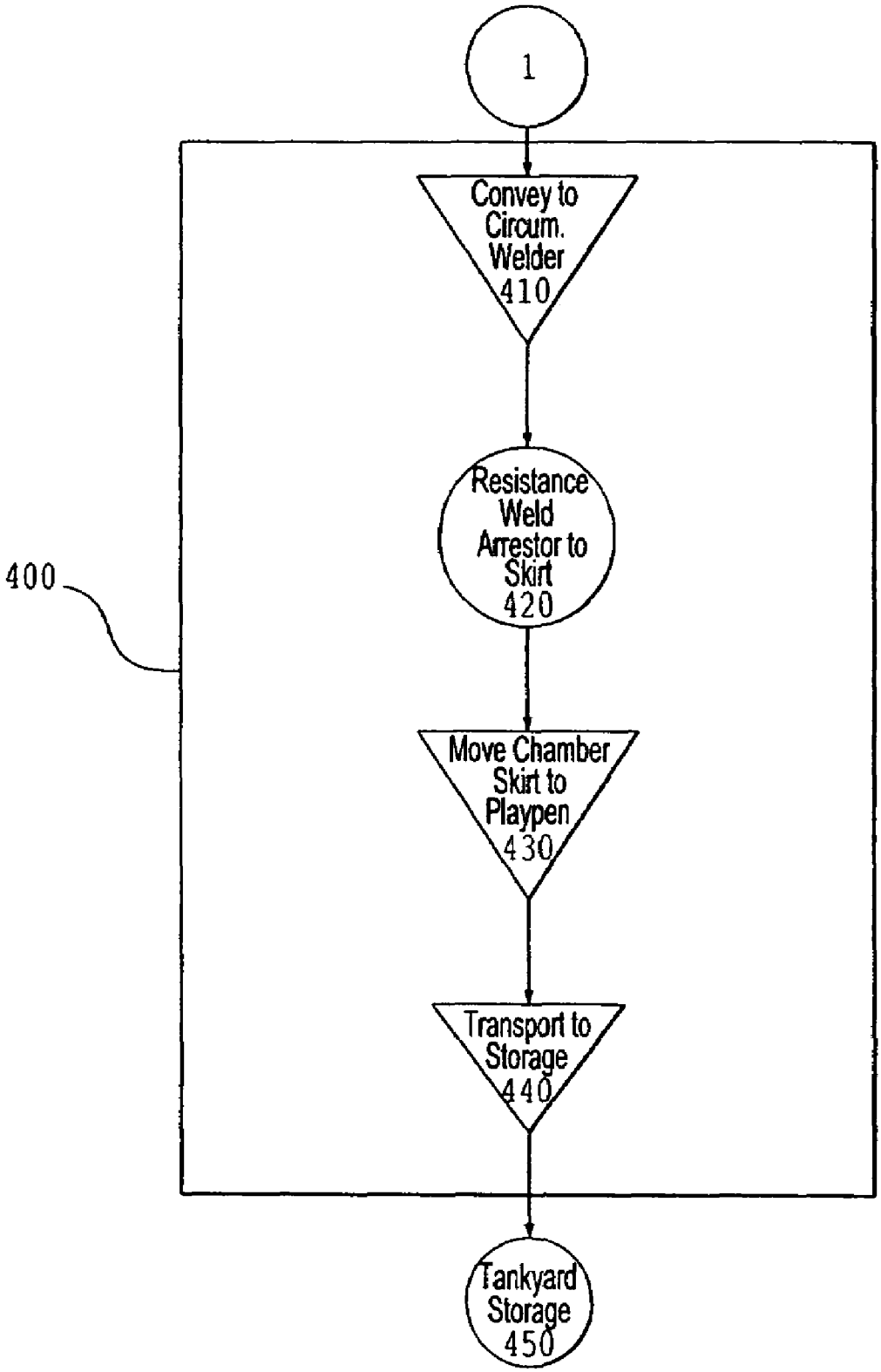
FIG. 4B is a continuation of the flow chart represented in FIG. 4A.

FIGS. 4A and 4B provide a flow chart representing a method of manufacturing the portion 50 of the combustion chamber 24 for use in a water heater 10 according to aspects of this invention. While the method of FIGS. 4A and 4B includes steps presented in an exemplary order, it will be appreciated that the order is optionally changed, one or more steps are optionally removed, and one or more steps are optionally added, depending upon the particular structure of the combustion chamber 24. Referring to an exemplary method generally, it includes the steps of seam welding 100, expanding and beading 200, spot welding 300, and circumferential welding 400.

For purposes of illustration, however, the method illustrated in FIGS. 4A and 4B will now be described in detail. As a first step of the exemplary method, blank sheets of metal are pressed in a press room of a manufacturing facility at step 90. Trays of stacked blank sheets are then transported and staged at step 110. Each blank sheet is then rolled via a rolling machine at step 120 to form a skirt 46. This forming step includes rolling the sheet metal to position edges 54 and 56 thereof proximal one another (illustrated in FIG. 2). The skirt 46 is then seam welded at step 130, where the edges 54 and 56 of the skirt 46 are seam welded together to form a continuous skirt (not shown). At this point, the skirt 46 has an inner surface 46I.

Steps 110, 120, and 130 are optionally carried out by a single machine operated by two operators. It is contemplated that multiple machines can be used and that fewer or more operators may be assigned to operate such machines.

The skirt 46 is then conveyed to an expander and beader machine at step 210. The bottom portion 52B of the skirt 46 is circumferentially expanded, and the top portion 52T of the skirt 46 is circumferentially beaded. While these operations are performed by two machines, one for expanding and the other for beading, it is contemplated that these operation can be performed by fewer or more machines, depending upon the configuration of the skirt 46.

The skirt 46 is then conveyed at step 310 to a spot welding area for spot welding at step 320. Concurrently, arrestor plates 34 and burner support brackets 38 are transported from a central warehouse at step 340 and are staged at step 330 for assembly in the spot welding area at step 320.

Edge portion 42E of an arrestor plate 34 is spot welded to the inner surface 46I of a skirt 46 via a spot welding machine in the spot welding area at step 320. In other words, the edge portion 42E of the arrestor plate 34 is spot welded to the inner surface of the expanded portion 52B of the skirt 46. Specifically, the arrestor plate 34 is spot welded at a location adjacent a shoulder formed between the main body of the skirt 46 and the expanded portion 52B of the skirt 46. The spot weld may include three spot weld locations in order to fix the arrestor plate 34 to the skirt 46 for further processing. Though two or more spot welds may be helpful to maintain an alignment between the arrestor plate 34 and the skirt 46, a single spot weld is contemplated as well.

A burner support bracket 38 is spot welded to the imperforate securement area 42S of arrestor plate 34. If an imperforated securement area 42S was not previously formed, a rectangular area 42S can be crimped down to form such an imperforate securement area 42S on which the burner support structure 38 may be suitably mounted. In other words, if louvers 48 exist on the arrestor plate 34 where the burner support bracket 38 is to be welded to the arrestor plate 34, a portion of such louvers 48 can be substantially closed.

The spot welding operations performed in step 320 can be performed by two spot welding machines, one for spot welding the burner support bracket 38 to the arrestor plate 34 and the other for spot welding the arrestor plate 34 to the skirt 46. It is also contemplated that these operations can be performed by a single machine.

At this point, the three components illustrated in FIG. 2, i.e., the skirt 46, the arrestor plate 34, and the burner support bracket 38, are preliminarily assembled to form the portion 50 of the combustion chamber 24.

As represented by symbol "1," the flow chart representation of the method of manufacturing the portion 50 of the combustion chamber 24 continues from FIG. 4A to FIG. 4B. The portion assembly 50 of the combustion chamber 24 is then conveyed at step 410 to a circumferential welding machine in a circumferential welding area in step 420. The edge portion 42E of the arrestor plate 34 is circumferentially welded to the inner surface 46I of the skirt 46, thereby forming a seal between the arrestor plate 34 and the inner surface 461 of the skirt 46. More specifically, a continuous weld is formed at or near the circumferential edge 42E of the arrestor plate 34 where it meets the inner surface 46I of the skirt 46. Thus, a continuous weld bead is formed, thereby preventing the flow of air between the edge 42E of the arrestor plate 34 and the inner surface 46I of the arrestor plate 34.

At this point, the portion 50 of the combustion chamber 24 is fully assembled. The assembly is then moved to a staging area at step 430, transported at step 440 to a storage area at step 560, and placed in tankyard storage at step 450. The combustion chamber portion 50 can then be used in the assembly of a water heater 10.

While preferred embodiments of the invention have been shown and described herein, it will be understood that such embodiments are provided by way of example only. Numerous variations, changes and substitutions will occur to those skilled in the art without departing from the spirit of the invention. For example, while the flame arrestor plate body 42 illustratively has a circular shape and covers essentially the entire bottom end of the combustion chamber 24, it could have a different shape and cover a lesser or greater portion of the bottom end of the combustion chamber 24. For example, the plate body 42 could have a rectangular shape and be an insert in a portion of a larger imperforate metal plate complementarily mounted within the open bottom end of the combustion chamber 24.

Also, the exemplary method illustrated in the figures can be modified within the scope of this invention. For example, the order of the steps is not critical to the invention, and steps can be added or removed to the method depending upon details of the design of the combustion chamber 24.

Accordingly, it is intended that the appended claims cover all such variations as fall within the spirit and scope of the invention.

What is claimed:

1. A method of manufacturing a combustion chamber of a water heater, said method comprising the steps of:

forming a skirt;

circumferentially expanding a portion of the skirt; and welding a flat plate to the expanded portion of the skirt, the flat plate including inlet openings that are configured for permitting a flow of combustion air into the combustion chamber while limiting an outflow of flames from the combustion chamber.

2. The method recited in claim 1, wherein said circumferentially expanding step comprises forming a shoulder in the skirt adjacent which an edge portion of the plate can be positioned.

3. The method recited in claim 2, further comprising the step of positioning the edge portion of the plate adjacent the shoulder formed in the skirt.

4. The method recited in claim 1, said welding step comprising spot welding an edge portion of the plate to the skirt.

5. The method recited in claim 1, said welding step comprising circumferentially welding the edge portion of the plate to the skirt, thereby forming a seal between the plate and the skirt.

6. A method of manufacturing a combustion chamber of a water heater having a skirt and a plate, said method comprising the steps of:

forming a skirt having a shoulder;

positioning an edge portion of the plate adjacent a revolved interior surface of the shoulder of the skirt; and welding the plate to the skirt, the plate including inlet openings that are configured for permitting a flow of combustion air into the combustion chamber while limiting an outflow of flames from the combustion chamber, thereby forming a seal between the plate and the revolved interior surface of the skirt.

7. The method recited in claim 6, further comprising the step of circumferentially expanding a portion of the skirt to form the shoulder in the skirt adjacent which the edge portion of the plate can be positioned.

8. A method of manufacturing a combustion chamber of a water heater having a skirt and a plate, said method comprising the steps of:

forming a skirt;

circumferentially expanding a portion of the skirt to form a shoulder in the skirt; and positioning the an edge portion of the plate adjacent the shoulder of the skirt, the plate including inlet openings that are configured for permitting a flow of combustion air into the combustion chamber while limiting an outflow of flames from the combustion chamber; and welding the plate to the skirt so as to form a seal between the plate and the skirt.

9. The method recited in claim 8, said welding step comprising spot welding the edge portion of the plate to the skirt.

10. The method recited in claim 8, said welding step comprising circumferentially welding the edge portion of the plate to the skirt, thereby forming the seal between the plate and the skirt.

* * * * *

UNITED STATES PATENT AND TRADEMARK OFFICE

CERTIFICATE OF CORRECTION

PATENT NO. : 7,665,211 B2
APPLICATION NO. : 11/713902
DATED : February 23, 2010
INVENTOR(S) : Garrett Doss et al.

It is certified that error appears in the above-identified patent and that said Letters Patent is hereby corrected as shown below:

In claim 8 of the Letters Patent, at column 8, line 7, "positioning the an edge" should read -- positioning an edge --

Signed and Sealed this

Thirteenth Day of July, 2010

David J. Kappos

David J. Kappos
*Director of the United States Patent and Trademark Office*